US005752474A

United States Patent [19]

Ban et al.

[11] Patent Number: 5,752,474

[45] Date of Patent: May 19, 1998

[54] VISCOUS HEATER

[75] Inventors: Takashi Ban; Hidefumi Mori; Kiyoshi Yagi, all of Kariya, Japan

[73] Assignee: Kabushiki Kaisha Toyoda Jidoshokki Seisakusho, Kariya, Japan

[21] Appl. No.: 836,653

[22] PCT Filed: Aug. 22, 1996

[86] PCT No.: PCT/JP96/02362

§ 371 Date: Apr. 23, 1997

§ 102(e) Date: Apr. 23, 1997

[87] PCT Pub. No.: WO97/08002

PCT Pub. Date: Jun. 3, 1997

[30] Foreign Application Priority Data

Aug. 25, 1995 [JP] Japan ..... 7-217035

[51] Int. Cl.[6] ..... F22B 3/06

[52] U.S. Cl. ..... 122/26; 123/142.5 R; 126/247

[58] Field of Search ..... 122/26; 126/247; 123/142.5 R

[56] References Cited

U.S. PATENT DOCUMENTS

| | | | |
|---|---|---|---|
| 4,143,639 | 3/1979 | Frenette | 122/26 |
| 4,277,020 | 7/1981 | Grenier | 126/247 |
| 4,424,797 | 1/1984 | Perkins | 122/26 |
| 4,664,068 | 5/1987 | Kretchmar et al. | 126/247 |
| 4,773,388 | 9/1988 | Herbulot et al. | 126/247 |
| 4,993,377 | 2/1991 | Itakura . | |
| 5,419,306 | 5/1995 | Huffmann | 126/247 |
| 5,573,184 | 11/1996 | Martin | 122/26 |
| 5,577,467 | 11/1996 | Bormann | 126/247 |

FOREIGN PATENT DOCUMENTS 2246823 10/1990 Japan .

*Primary Examiner*—Erick R. Solis

*Attorney, Agent, or Firm*—Brooks Haidt Haffner and Delahunty

[57] ABSTRACT

A viscous heater is provided which can securely inhibit a viscous fluid from leaking even after extended use. For instance, the heater is provided with a shaft-sealing apparatus which seals a driving shaft between a heat-generating chamber and a bearing apparatus. The shaft-sealing apparatus is arranged so that it is cooled by a front water jacket which is disposed adjacent to it.

9 Claims, 5 Drawing Sheets

VISCOUS HEATER

TECHNICAL FIELD

The present invention relates to a viscous heater in which a viscous fluid is caused to generate heat by shearing. The resulting heat is utilized as a thermal source for heating by carrying out heat exchange with a circulating fluid which circulates in a radiator chamber.

BACKGROUND ART

Conventionally, in Japanese Unexamined Patent Publication (KOKAI) No. 2-246,823, a viscous heater is disclosed which is utilized as a heating apparatus for a vehicle. In this viscous heater, a front housing and a rear housing are disposed so as to face with each other, and are fastened by through bolts, thereby forming a heat-generating chamber and a water jacket therein. The water jacket is disposed around an outer region of the heat-generating chamber. In the water jacket, water is circulated being taken in through a water inlet port, and delivered out to an external heating circuit through a water outlet port. In the front housing, a driving shaft is held rotatably via a bearing apparatus. To the driving shaft, a rotor is fixed so that it can rotate in the heat-generating chamber. A wall surface of the heat-generating chamber and an outer surface of the rotor constitute labyrinth grooves which approach each other. In a space between the wall surface of the heat-generating chamber and the outer surface of the rotor, a viscous fluid, such as a silicone oil, is interposed.

In the viscous heater built into a vehicle heating apparatus, the rotor rotates in the heat-generating chamber when the driving shaft is driven by an engine. Accordingly, the viscous fluid is caused to generate heat by shearing in the space between the wall surface of the heat-generating chamber and the outer surface of the rotor. The thus generated heat is heat-exchanged to the circulating water in the water jacket. The heated circulating water is used in a heating circuit to heat a vehicle.

However, in the above-described conventional viscous heater, there is a fear of leaking the viscous fluid to the outside, because the heat-generating chamber is communicated with the outside by way of the bearing apparatus. In view of this, it is possible to think of disposing a shaft-sealing apparatus. However, when a shaft-sealing apparatus is simply provided, there remains a fear that a rubber-like material in the shaft-sealing apparatus is degraded by the thermal influence, which results from the viscous fluid held in the heat-generating chamber. Moreover, after extended use, there also arises a fear of leaking the viscous fluid.

It is therefore an object of the present invention to provide a viscous heater which can inhibit a viscous fluid from leaking even after extended use.

SUMMARY OF THE INVENTION

A viscous heater in accordance with one aspect of the present invention comprises:

a housing in which a heat-generating chamber, and a radiator chamber are formed, the radiator chamber neighboring the heat-generating chamber and circulating a circulating fluid therein;

a driving shaft held rotatably to the housing by way of a bearing apparatus;

a rotor disposed in the heat-generating chamber rotatably by the driving shaft; and a viscous fluid interposed in a space between a wall surface of the heat-generating chamber and an outer surface of the rotor, and caused to generate heat by the rotating rotor;

wherein the housing is provided with a shaft-sealing apparatus sealing the driving shaft between the heat-generating chamber and the bearing apparatus, and with cooling means for cooling the shaft-sealing apparatus.

In the viscous heater mentioned above, there is no fear of leaking the viscous fluid to the outside, because the shaft-sealing apparatus is disposed to seal the driving shaft between the heat-generating chamber and the bearing apparatus. Moreover, the fear of deteriorating a rubber-like material in the shaft-sealing apparatus by the thermal influence, which results from the viscous fluid held in the heating chamber, is diminished, because the rubber-like material in the shaft-sealing apparatus is cooled actively by the cooling means.

A viscous heater in accordance with a further aspect of the present invention is characterized in that the cooling means of the viscous heater is constituted by forming the radiator chamber adjacent to the shaft-sealing apparatus.

In the viscous heater set forth above, a rubber-like material in the shaft-sealing apparatus is cooled indirectly by the circulating fluid circulating in the radiator chamber, because the radiator chamber is formed adjacent to the shaft-sealing apparatus. Accordingly, the fear of deteriorating a rubber-like material by the thermal influence, which results from the viscous fluid held in the heating chamber, is diminished. Moreover, a temperature increment is thereby realized in the circulating fluid. Here, the term, "adjacent to", means that the radiator chamber and the shaft-sealing apparatus are disposed close to each other by way of a wall of the housing only.

A viscous heater in accordance with a further aspect of the present invention comprises:

a housing in which a heat-generating chamber, and a radiator chamber are formed, the radiator chamber neighboring the heat-generating chamber and circulating a circulating fluid therein;

a driving shaft held rotatably to the housing by way of a bearing apparatus;

a rotor disposed in the heat-generating chamber rotatably by the driving shaft; and a viscous fluid interposed in a space between a wall surface of the heat-generating chamber and an outer surface of the rotor, and caused to generate heat by the rotating rotor;

wherein the housing is provided with a shaft-sealing apparatus sealing the driving shaft between the heat-generating chamber and the bearing apparatus, and with radiating means for radiating the heat caused in the viscous fluid, the radiating means disposed between the heat-generating chamber and the bearing apparatus.

In the viscous heater set forth above, there is no fear of leaking the viscous fluid to the outside, because the shaft-sealing apparatus for sealing the driving shaft is disposed between the heat-generating chamber and the bearing apparatus. Moreover, the durability of the shaft-sealing apparatus is enhanced, because the radiating means draws the heat from the viscous fluid before the viscous fluid arrives at the shaft-sealing apparatus.

A viscous heater in accordance with a further aspect of the present invention is characterized in that the radiating means set forth above is constituted by disposing the shaft-sealing apparatus so as to be separated away (i.e., spaced apart) from the heat-generating chamber.

In the viscous heater set forth above, the fear of deteriorating a rubber-like material in the shaft-sealing apparatus by the thermal influence, which results from the viscous fluid held in the heating chamber, is diminished, because the shaft-sealing apparatus is separated away from the heat-generating chamber. Here, the term, "being separated away from", means a state in which the viscous fluid loses the heat caused therein while it comes out from the heat-generating chamber and before it arrives at the shaft-sealing apparatus.

A viscous heater in accordance with a further aspect of the present invention is characterized in that the housing of the viscous heater set forth above includes a plate, and a housing body constituting the rest of the housing, the plate forming a wall surface of the heat-generating chamber with an axial end surface and a wall surface of the radiator chamber with another axial end surface, and having a boss into which the driving shaft is fitted, the boss having a leading end with the shaft-sealing apparatus provided, thereby positioning the radiator chamber in rear of the shaft-sealing apparatus.

The viscous heater set forth above embodies the cooling means or radiating means of the viscous heater previously described. Hence, the durability of the shaft-sealing apparatus is further enhanced, because the shaft-sealing apparatus is cooled by the circulating fluid circulating in the radiator chamber disposed to the rear of the shaft-sealing apparatus, and because the radiating means draws the heat from the viscous fluid before the viscous fluid arrives at the shaft-sealing apparatus.

A viscous heater in accordance with a further aspect of the present invention is characterized in that a labyrinth is formed in an inner peripheral surface of the boss of the viscous heater set forth in claim 5.

When a labyrinth is formed in an inner peripheral surface of the boss, the heat can be radiated off from the boss to the labyrinth to cool the shaft-sealing apparatus (the fin effect), and simultaneously the viscous fluid can be kept from leaking by the labyrinth (the sealing effect).

DETAILED DESCRIPTION OF THE INVENTION

The First through Third Preferred Embodiments embodying the present invention will be hereinafter described with reference to the drawings.

(First Preferred Embodiment)

Figure 1:
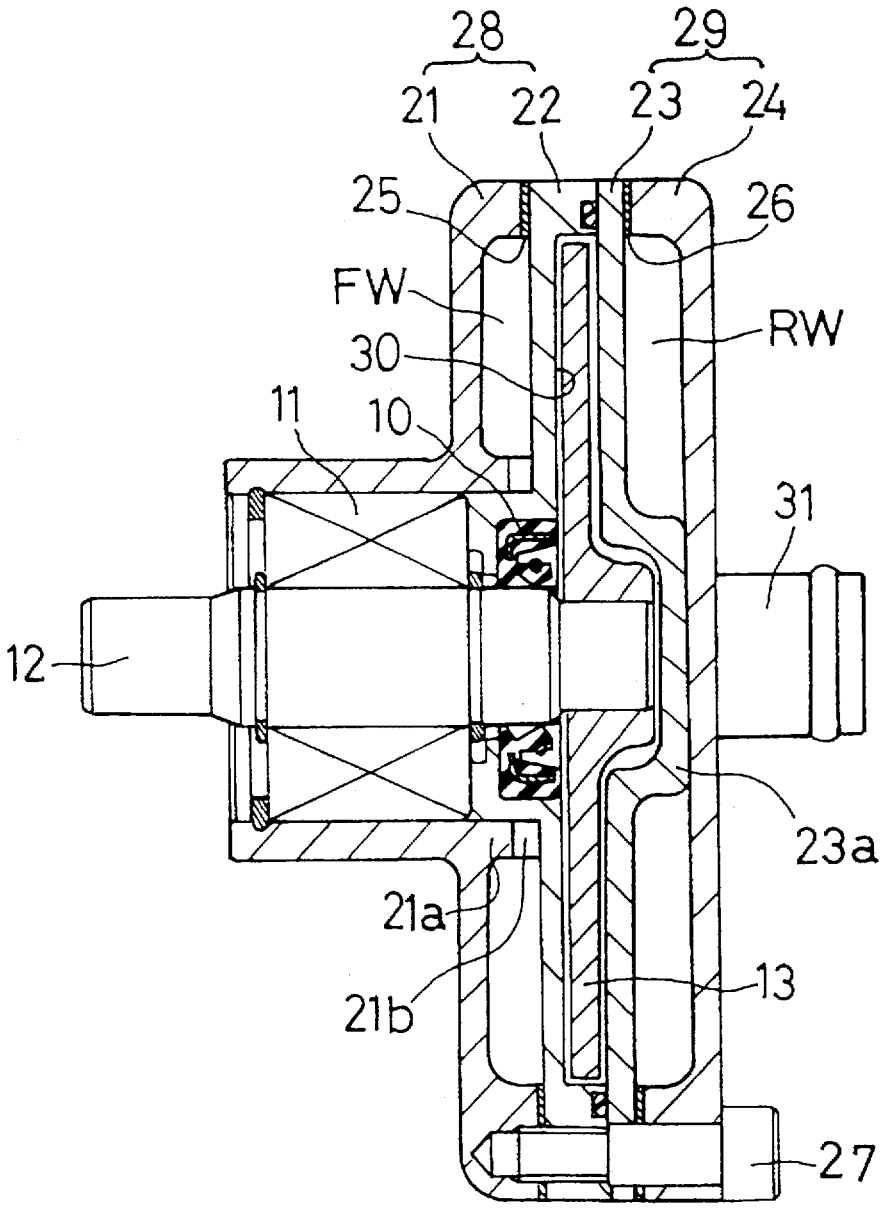
FIG. 1 is a vertical cross-sectional view of a viscous heater of a First Preferred Embodiment.

As illustrated in FIG. 1, in the viscous heater, a front housing body 21, a front plate 22, a rear plate 23 and a rear housing body 24 are overlapped and fastened by a plurality of through bolts 27 with a gasket 25 interposed between the front housing body 21 and the front plate 22, and with a gasket 26 interposed between the rear plate 23 and the rear housing body 24. The front and rear plates 22 and 23 are formed of an aluminum-based alloy. Here, the front housing body 21 and the front plate 22 constitute a front housing 28, and the rear plate 23 and the rear housing body 24 constitute a rear housing body 29. Further, a concavity is dented in a rear-end surface of the front plate 22, and forms a heat-generating chamber 30 together with a flat front-end surface of the rear plate 23. Furthermore, an inner surface of the front housing body 21 and a front-end surface of the front plate 22 form a front water jacket FW. The front water jacket FW works as the front radiator chamber neighboring in front of the heat-generating chamber 30. Moreover, a rear-end surface of the rear plate 23 and an inner surface of the rear housing body 24 form a rear water jacket RW. The rear water jacket RW works as the rear radiator chamber neighboring in rear of the heat-generating chamber 30.

Figure 2:
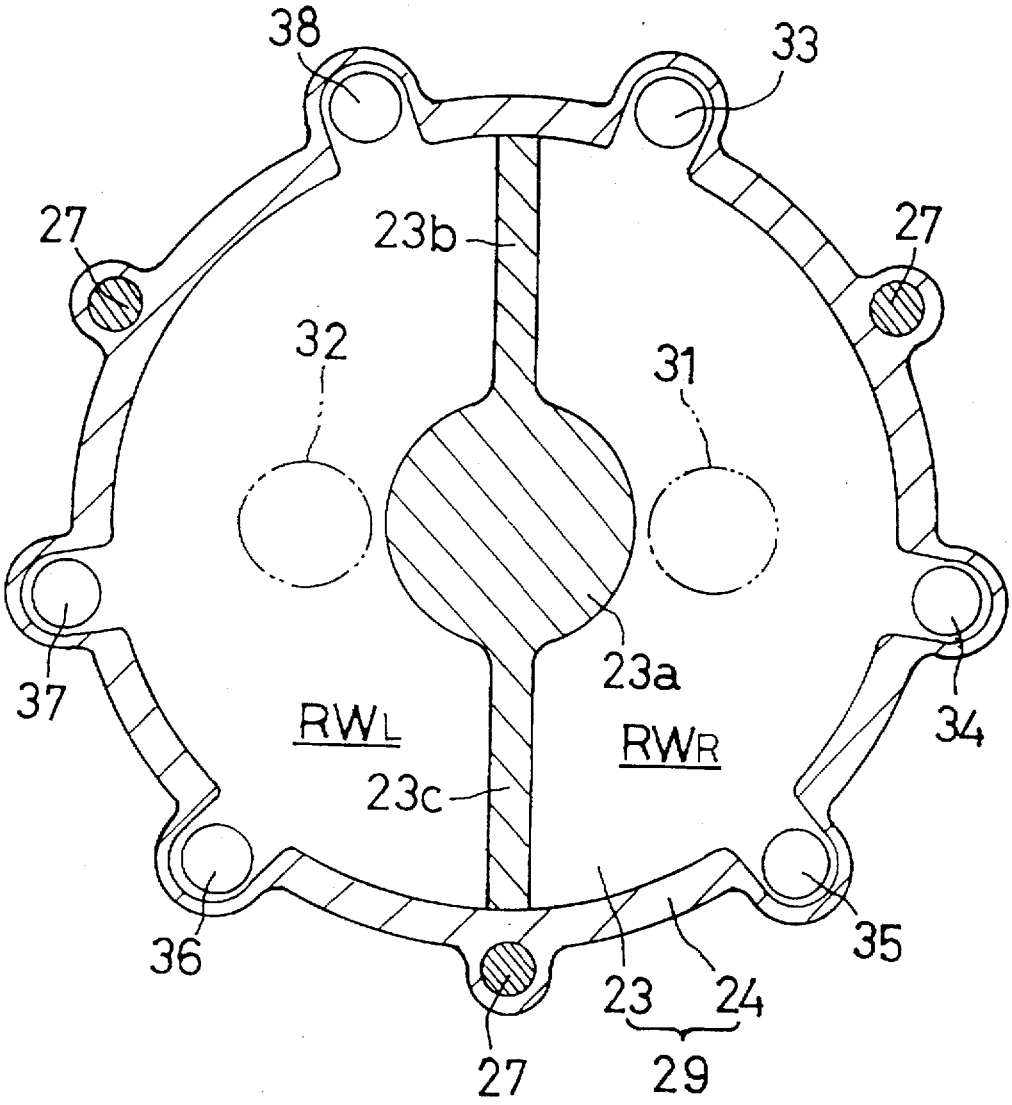
FIG. 2 is a horizontal cross-sectional view of the viscous heater of the First Preferred Embodiment.

As illustrated in FIG. 2, in a central region on a rear surface of the rear housing body 24, a water inlet port 31 and a water outlet port 32 are formed next to each other. The water inlet port 31 works as the first port for taking in circulating water operating as the circulating fluid from an external heating circuit (not shown). The water outlet port 32 works as the second port for delivering the circulating water out to the heating circuit. The water inlet port 31 and the water outlet port 32 are communicated with the rear water jacket RW.

On a rear-end surface of the rear plate 23, a cylindrical convexity **23*a* is protruded in a central area. Moreover, partition walls 23*b* and 23*c*, which extend from the convexity 23*a* in opposite radial directions, are protruded between the water inlet port 31 and the water outlet port 32. As illustrated in FIG. 1, the leading end of the convexity 23*a*, and the partition walls 23*b* and 23*c* contacts with the inner surface of the rear housing body 24**.

As illustrated in FIG. 2, in the gasket 26, the rear plate 23, the front plate 22 and the gasket 25, water passages 33 through 38 are drilled through, and are disposed between the through bolts 27 at equal intervals. The water passages 33 through 38 are each formed as a round hole having the same cross-sectional area. Further, the water passages 33 through 35 are communicated from the rear water jacket RW, in which the water inlet port 31 is formed, to the front water jacket FW. Furthermore, the water passages 36 through 38 are communicated from the front water jacket FW to the rear water jacket RW, in which the water outlet port 32 is formed.

As illustrated in FIG. 1, a shaft-sealing apparatus 10 is disposed in the front plate 22, and a bearing apparatus 11 is disposed in the front housing body 21. Further, an inner boss **21*a* is protruded in the front housing body 21, and is extended to the side of the heat-generating chamber 30 in an axial direction. A plurality of openings 21*b* are drilled through the inner boss 21*a*, and work as the cooling means. Accordingly, the front water jacket FW is formed adjacent to the shaft-sealing apparatus 10 by leaving a margin of thickness (a wall) of the front plate 22 only. Furthermore, by way of the shaft-sealing apparatus 10 and the bearing apparatus 11, a driving shaft 12 is held rotatably. At the trailing end of the driving shaft 12, a plate-shaped rotor 13 is press-fitted so that it can rotate in the heat-generating chamber 30. A silicone oil, working as the viscous fluid, is interposed in the space between the wall surface of the heat-generating chamber 30 and the outer surface of the rotor 13. Thus, in the viscous heater, there is no fear of leaking the silicone oil to the outside, because the shaft-sealing apparatus 10 is disposed between the heat-generating chamber 30 and the bearing apparatus 11 in the front plate 22. At the leading end of the driving shaft 12**, a pulley (not shown) is fixed by a bolt (not shown). The pulley is rotated by a vehicle engine via a belt.

In the viscous heater built-into a vehicle heating apparatus, the rotor 13 is rotated in the heat-generating chamber 30 when the driving shaft 12 is driven by the engine by way of the pulley. Accordingly, the silicone oil is sheared in the space between the wall surface of the heat-generating chamber 30 and the outer surface of the rotor 13, thereby generating heat. The resulting heat is heat-exchanged to the circulating water flowing in the front water jacket FW and the rear water jacket RW, and the thus heated circulating water is used for heating a vehicle in the heating circuit.

Figure 3:
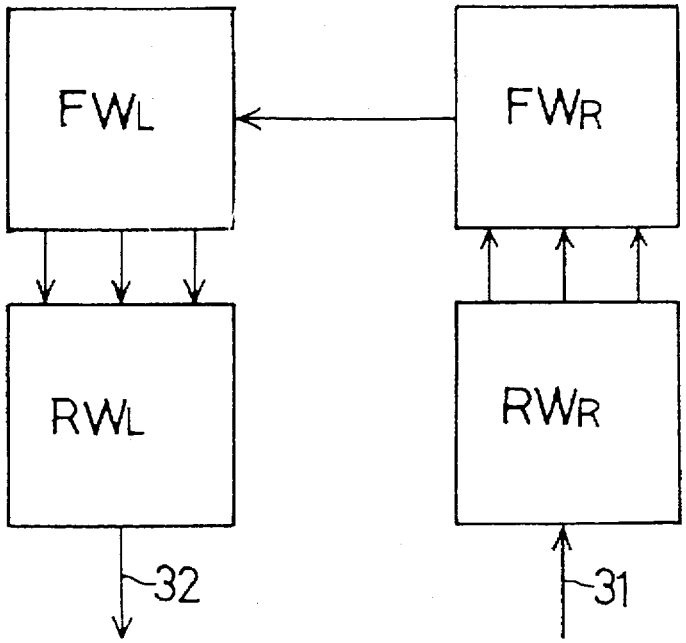
FIG. 3 is concerned with the viscous heater of the First Preferred Embodiment, and is a schematic diagram for illustrating a flow of circulating water therein.

At this moment, as illustrated in FIG. 3, the circulating water is taken in into a right-side chamber $RW_R$, viewed from the rear of the rear water jacket RW, through the water inlet port 31. Then, the circulating water follows the route in the water passages 33 through 35, and arrives at a right-side chamber $FW_R$, viewed from the rear of the front water jacket FW. Further, the circulating water arrives at a left-side chamber $FW_L$, viewed from the rear of the front water jacket FW. Note that the left-side chamber $FW_L$ is formed integrally with the right-side chamber $FW_R$. Furthermore, the circulating water follows the route in the water passages 36 through 38, and arrives at a right-side chamber $RW_L$, viewed from the rear of the rear water jacket RW. Eventually, the circulating water is delivered out to the heating circuit through the water inlet port 32. Thus, in the viscous heater, there is no fear of short-circuiting or trapping the circulating water in the rear water jacket RW, because the circulating water is circulated along the specific routes in the rear water jacket RW. In addition, heat exchange can be also carried out by the water passages 33 through 38 efficiently.

As a result, the viscous heater is capable of carrying out full heat exchange.

Further, in the viscous heater, the rubber-like member of the shaft-sealing apparatus 10 is cooled indirectly by the circulating water which circulates in the front water jacket FW, because the front water jacket FW is formed up to the vicinity of the shaft-sealing apparatus 10. Accordingly, the fear of deteriorating the rubber-like member by the thermal effect, which results from the silicone oil held in the heat-generating chamber 30, is diminished. Furthermore, this advantageous effect realizes the temperature increment in the circulating water. Moreover, the aforementioned cooling, etc., of the shaft-sealing apparatus 10 can be carried out efficiently, because the front plate 22 is formed of an aluminum-based alloy of good thermal conductivity.

As a result, the viscous heater is capable of securely inhibiting the silicone oil from leaking even after extended use.

Note that, instead of the pulley, an electromagnetic clutch can be employed to intermittently drive the driving shaft 12.

(Second Preferred Embodiment)

Figure 4:
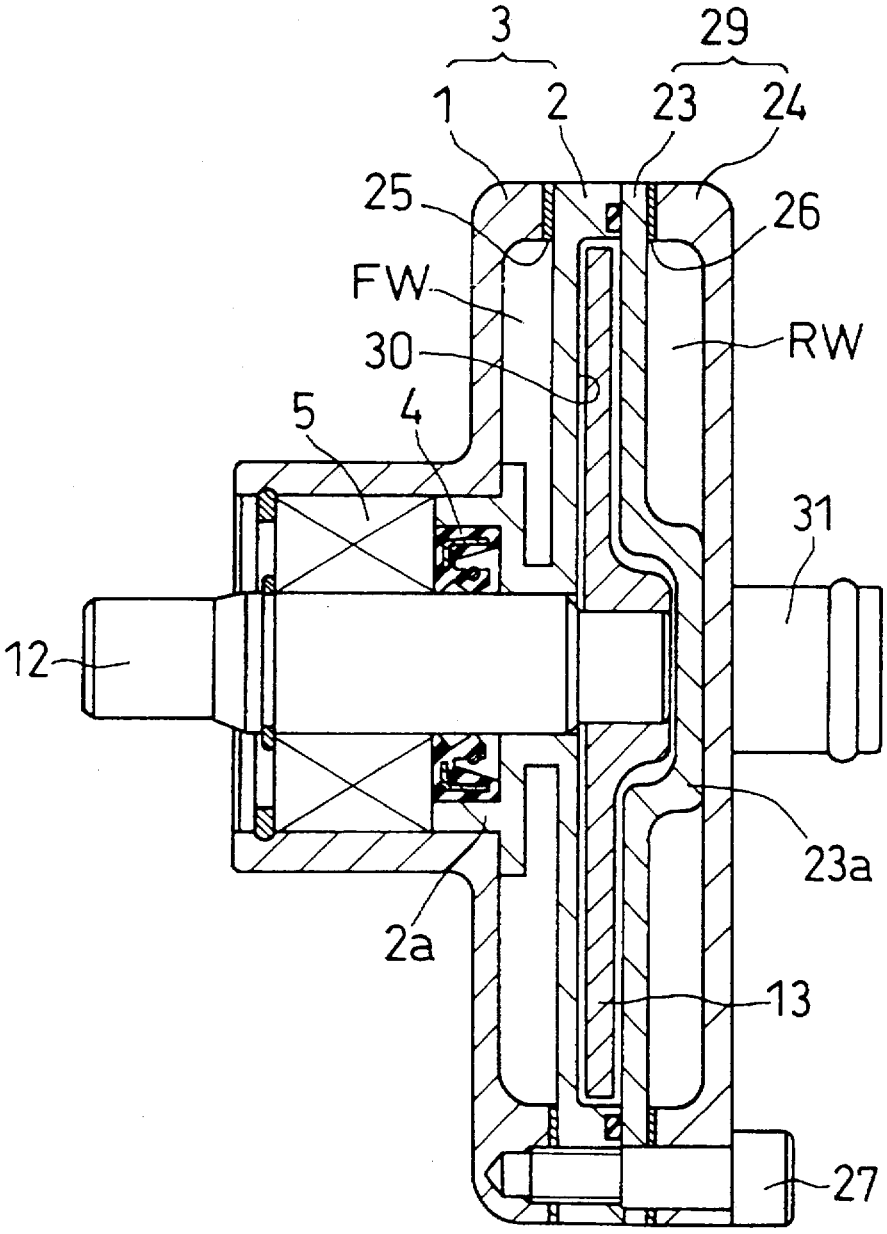
FIG. 4 is a vertical cross-sectional view of a viscous heater of a Second Preferred Embodiment.

As illustrated in FIG. 4, in the viscous heater, a front housing body 1 is employed which is free from the protruding inner boss disposed in that of the First Preferred Embodiment. Further, as a front plate 2, a member having a boss **2*a* is employed. Into the boss 2*a*, a driving shaft 12 is fitted. These members constitute a front housing 3. Furthermore, a shaft-sealing apparatus 4 is disposed at the leading end of the boss 2*a* of the front plate 2 so that a front water jacket FW is positioned to the rear of the shaft-sealing apparatus 4. Moreover, a bearing apparatus 5 is disposed in front of the shaft-sealing apparatus 4 in the front housing body 1. Consequently, the boss 2*a* separates the shaft-sealing apparatus 4 from the heat-generating chamber 30**. Unless otherwise specified, the other arrangements of the Second Preferred Embodiment are identical with those of the First Preferred Embodiment.

In the viscous heater, the shaft-sealing apparatus 4 is cooled by the circulating water which circulates in the front water jacket FW, because the front water jacket FW is positioned to the rear of the shaft-sealing apparatus 4. Moreover, in this arrangement, the silicone oil is deprived of heat by the front water jacket FW while it arrives at the shaft-sealing apparatus 4. Hence, compared with the arrangement where the shaft-sealing apparatus 4 is disposed adjacent to the heat-generating chamber 30, the durability of the shaft-sealing apparatus 4 can be readily improved. Unless otherwise specified, the Second Preferred Embodiment operates and effects advantages in the same manner as the First Preferred Embodiment.

As a result, the thus constructed viscous heater can inhibit the silicone oil from leaking more securely than the First Preferred Embodiment does even after extended use.

(Third Preferred Embodiment)

Figure 5:
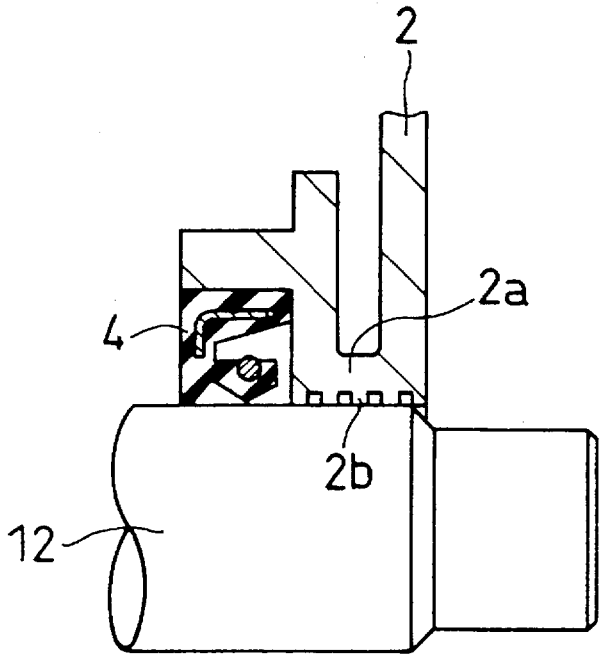
FIG. 5 is a vertical cross-sectional view of a major portion of a viscous heater of a Third Preferred Embodiment.

As illustrated in FIG. 5, in the viscous heater, a labyrinth **2*b* is formed in an inner surface of a boss 2*a* of a front plate 2**. Unless otherwise specified, the other arrangements of the Third Preferred Embodiment are identical with those of the First and Second Preferred Embodiments.

In the viscous heater, the heat of the silicone oil resulting from the heat generation is radiated off from the labyrinth **2*b* to the boss 2*a*, and further to the front water jacket FW. Accordingly, while the silicone oil arrives at the shaft-sealing apparatus 4, the Third Preferred Embodiment can realize the temperature decrement in the silicone oil more efficiently than the Second Preferred Embodiment does. At the same time, in the Third Preferred Embodiment, the silicone oil can be sealed by the labyrinth 2*b*. The sealing of the silicone oil reduces the load exerted to the shaft-sealing apparatus 4**. Unless otherwise specified, the Third Preferred Embodiment operates and effects advantages in the same manner as the First and Second Preferred Embodiments.

We claim:

1. A viscous heater, comprising:

a housing including a heat-generating chamber, a radiator chamber adjacent the heat-generating chamber, and means for enabling coolant fluid to be circulated through said radiator chamber;

a driving shaft mounted rotatably within said housing by a bearing apparatus;

a rotor disposed in said heat-generating chamber for rotation by said driving shaft;

a viscous fluid interposed in a space between a wall surface of said heat-generating chamber and an outer surface of said rotor, whereby rotation of said rotor causes said viscous fluid to become heated;

a shaft-sealing apparatus disposed about said driving shaft between said heat-generating chamber and said bearing apparatus;

and cooling means for cooling said shaft-sealing apparatus, said cooling means having a portion of said radiator chamber disposed in heat absorbing proximity to said shaft-sealing apparatus.

2. A viscous heater according to claim 1, wherein said housing includes a plate and a housing body, the plate extending generally radially outwardly from said driving shaft and having opposite radial wall surfaces, one of which wall surfaces constitutes a wall surface of said heat-generating chamber while the other of said wall surfaces constitutes a wall surface of said radiator chamber, said plate further having a boss through which said driving shaft is fitted, the boss extending from said plate on the side away from said heat-generating chamber toward a leading end that is provided with said shaft-sealing apparatus, thereby positioning said radiator chamber to the rear of said shaft-sealing apparatus.

3. A viscous heater according to claim 2, wherein a labyrinth is formed in an inner peripheral surface of said boss.

4. A viscous heater according to claim 1, wherein said portion of said radiator chamber is separated from said shaft-sealing apparatus by a single thickness of housing wall.

5. A viscous heater according to claim 4, wherein said housing comprises a front housing constituted by a front housing body and a front plate, and a rear housing constituted by a rear housing body and a rear plate; the interior of said front housing body having a boss surrounding said driving shaft and extending from said front housing body up to said heat-generating chamber; a plurality of openings formed through the walls of said boss, said openings being in fluid communication with said radiator chamber at the radially outer surface of said boss and being separated from said shaft-sealing apparatus by a portion of said front plate.

6. A viscous heater, comprising:

a housing including a heat-generating chamber, a radiator chamber adjacent the heat-generating chamber, and means for enabling coolant fluid to be circulated through said radiator chamber;

a driving shaft mounted rotatably within said housing by a bearing apparatus;

a rotor disposed in said heat-generating chamber for rotation by said driving shaft;

a viscous fluid interposed in a space between a wall surface of said heat-generating chamber and an outer surface of said rotor, whereby rotation of said rotor causes said viscous fluid to become heated;

a shaft-sealing apparatus disposed about said driving shaft between said heat-generating chamber and said bearing apparatus; and radiating means disposed between said heat-generating chamber and said bearing apparatus for radiating heat therefrom.

7. A viscous heater according to claim 6, wherein said radiating means is constituted by disposing said shaft-sealing apparatus spaced apart from said heat-generating chamber.

8. A viscous heater according to claim 7, wherein said housing includes a plate and a housing body, the plate extending generally radially outwardly from said driving shaft and having opposite radial wall surfaces, one of which wall surfaces constitutes a wall surface of said heat-generating chamber while the other of said wall surfaces constitutes a wall surface of said radiator chamber, said plate further having a boss through which said driving shaft is fitted, the boss extending from said plate on the side away from said heat-generating chamber toward a leading end that is provided with said shaft-sealing apparatus, thereby positioning said radiator chamber to the rear of said shaft-sealing apparatus.

9. A viscous heater according to claim 8, wherein a labyrinth is formed in an inner peripheral surface of said boss.

* * * * *